United States Patent [19]

Davis, Jr.

[11] 4,253,082

[45] Feb. 24, 1981

[54] RESISTANCE DISK

[76] Inventor: George B. Davis, Jr., 7512 Marbury Rd., Bethesda, Md. 20034

[21] Appl. No.: 64,801

[22] Filed: Aug. 8, 1979

Related U.S. Application Data

[63] Continuation-in-part of Ser. No. 7,323, Jan. 29, 1979, abandoned, which is a continuation-in-part of Ser. No. 826,899, Sep. 6, 1977, Pat. No. 4,137,518.

[51] Int. Cl.[2] ..... H01C 10/26

[52] U.S. Cl. ..... 338/150; 29/620; 338/142; 338/308; 427/103

[58] Field of Search ..... 338/150, 160, 307, 308, 338/314, 142; 29/620; 427/103

[56] References Cited

U.S. PATENT DOCUMENTS

| | | | |
|---|---|---|---|
| 2,939,097 | 5/1960 | Falco | 338/150 |
| 3,379,567 | 4/1968 | Wright | 338/89 |
| 3,676,594 | 7/1972 | Shore | 338/89 X |
| 4,134,096 | 1/1979 | Denes | 338/308 X |
| 4,137,518 | 1/1979 | Davis | 338/308 X |

*Primary Examiner*—C. L. Albritton

[57] ABSTRACT

A resistance disk that is so constructed that as the disk is rotated between a pair of fixed contact members, there is produced between the contacts a varying and random like resistance pattern of a character unobtainable with any other form of resistance apparatus and further including the feature whereby the varying resistance pattern may be selectively altered by radial movement of one of the contact members across the face of the disk.

14 Claims, 3 Drawing Figures

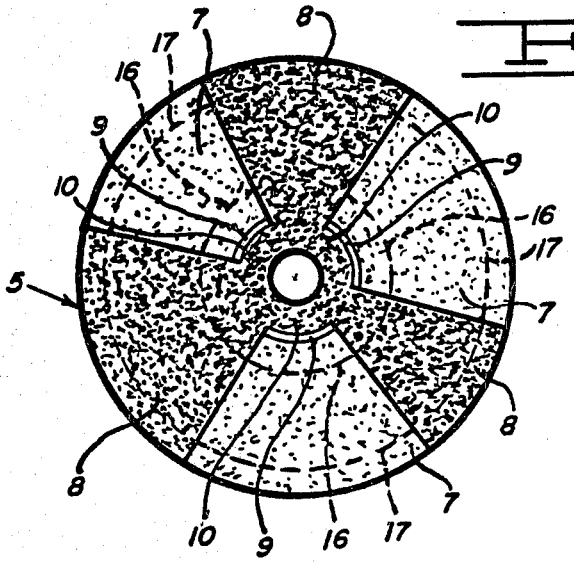
FIG 1
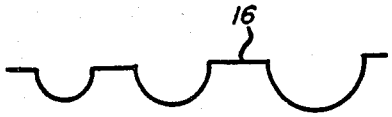
FIG 2
FIG 3
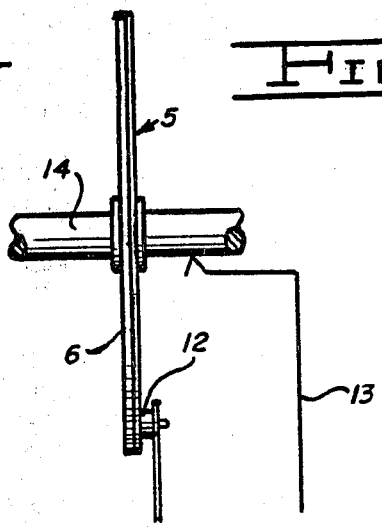

RESISTANCE DISK

This application is a continuation-in-part of application Ser. No 7,323 filed Jan. 29, 1979, abandoned, which is a continuation-in-part of Application Ser. No. 826,899, filed Sept. 6, 1977, now U.S. Pat. No. 4,137,518.

The resistance disk or plate of the present invention provides for varying in a unique and random like manner the resistance pattern applied between contact pairs electrically engaging the resistance surface of the disk and effected by rotary motion of the disk about its transverse axis. The device is primarily for low current application such as in the gating circuit of an SCR or TRIAC and DIAC combination or other such electronic circuitry.

It is an object of the present invention to provide a resistance disk operable, when rotated about its axis, to produce continually varying and random like resistance changes between spaced contacting members engaging respectively the center and outer resistance surface of the disk.

A further object is to provide a resistance disk wherein the random like resistance pattern produced across its engaging contacts may be selectively varied by radial movement of one of its engaging contacts toward or from the axis of the disk.

A still further object is to provide a resistance disk that is so constructed that random like resistance changes are effected across contact pairs engaging the surface of the disk and by way of a plurality of varying resistance paths extending both radially and circumferentially across the disk's surface and intermittently brought between the contact pairs by rotation of the disk about its transverse axis.

A still further object is to provide a resistance disk of a structure whereby upon rotation of the disk about its axis, a random like resistance pattern is effected between its engaging contact members by following a resistance path upon the disk that extends both radially and circumferentially over the disk's surface.

Further objects and advantages of the present device will become more apparent by referring to the following specification and drawings wherein:

FIG. 1 is a plan view of the resistance disk in elevation.

FIG. 2 is a side view of the disk as mounted for rotation about its axis and as engaged by contacting members electrically engaging the disk's surface.

FIG. 3 shows substantially the varied and random like resistance pattern as would be produced by a single rotation of the disk about its axis.

Referring now to the drawings and particularly to FIGS. 1 and 2 thereof wherein is shown the disk generally designated 5 with the plate or non-conductive body portion 6 of the disk preferably formed from plastic and upon which has been deposited or otherwise applied, a substantially uniform coating of relatively high resistance material 7. Radially extending from the center portion of the disk are a plurality of spokes or wedge shaped overlays 8 of highly conductive material and wherein each spoke is preferably of a different width and differentially spaced with respect to the other. This conductive overlay effectively shorts out any portion of the higher resistance surface it covers. The shaft 14, in addition to its purpose of rotating the disk, preferably serves as one of the disk's engaging contacts by connecting electrically with the conductive center portion of the spokes as at 10. Rotation of the disk between the contact pairs 12 and 13 produces across the contacts an intermittently varying and random like resistance pattern as selectively designed into the resistance structure of the disk.

Between the radially extending spokes 8 may be a cut such as 9 that extend through the resistance coating upon the disk and serve to electrically isolate radially the conductive center portion of the disk from the resistance surface 7 further out upon the disk and separating the spokes. These cuts prevent the more conductive center portion of the disk from electrically influencing the used resistance area 7 between the spokes as the disk is rotated. The spring arm of the contact 12 may be bent as necessary to place the contact 12 at any position between the tracking lines 16 and 17 to effectively shorten or lengthen the resistance path between the conductive spokes 8 as required to trim or otherwise produce the exact resistance pattern desired of the device.

While herein is shown the spokes 8 as extending to the outer edge of the disk these spokes may, if desired, extend to just within the outer tracking line 17 and still maintain their electrical influence upon the varied resistance pattern produced. Further, while herein is described the high resistance material of the disk as uniformly covering the surface of the disk, it is understood that if the two differing resistance surfaces upon the disk are applied as by printing or silkscreening, or the like, the high resistance surfaces 7 may be applied only between the conductive spokes 8 with the edges of the two resistance coatings electrically intersecting. Additionally, wherein the scribed line 9 is shown in close proximity to the disk's axis, this line may extend through the high resistance surface further out upon these resistance surfaces, is so desired.

What I therefore claim and desire to cover by letters patent is:

1. A variable resistor assembly including in combination, a non-conductive plate rotatable about a transverse axis, a resistance coating deposited upon said plate to form a relatively high resistance surface and extending substantially uniformly over the surface of said plate, a highly conductive coating disposed as an overlay upon said resistance surface and including spoke like extensions extending radially from substantially the axis of said plate and wherein between said spokes is exposed the resistance coating upon said plate, at least one substantially fixed contact member electrically engaging the said highly conductive overlay upon said plate, at least one second contact member radially spaced from the first said contact member and positioned to electrically engage in sequential order the resistance and conductive surfaces upon said plate as the plate is rotated whereby is produced and intermittent and continually changing resistance pattern between the contacts as the plate is caused to rotate about its axis.

2. A resistance plate as called for in claim 1 wherein a portion of said high resistance coating over said plate is removed from said plate between said spokes in close inner adjacency to center of said plate.

3. A resistance plate as called for in claim 1 wherein the inner ends of said radialy extending spokes of highly conductive material are electrically connected together adjacent the axis of the said plate.

4. A resistance plate as called for in claim 1 wherein said spokes are of differing widths.

5. A resistance plate as called for in claim 1 wherein said spokes are disposed in differing spaced relation with respact to each other about the surface of said plate.

6. A resistance plate as called for in claim 1 wherein said spokes are wedge shaped in configuration and with the diminishing end of said wedge extending substantially to the center of said plate.

7. A resistance plate as called for in claim 1 wherein the plate is circular in form and rotatable about its central disposed transverse axis.

8. A variable resistor assembly including in combination, a non-conductive plate rotatable about a transverse axis, a plurality of highly conductive spoke like surfaces extending radially from substantially the axis of said plate, a plurality of relatively high resistance surfaces disposed upon said plate between said conductive spokes and engaging electrically the conductive edge of said spokes, at least one first substantially fixed contact member electrically engaging the said highly conductive spoke like surfaces upon said plate, at least one second substantially fixed contact member radially spaced from said first contact member and positioned to electrically engage in sequential order the highly conductive spoke like surfaces upon said plate and the relatively high resistance surfaces between said spokes as the plate is rotated about its axis whereby is produced between the contacts a continually changing and varied resistance pattern as the plate is caused to rotate about its axis.

9. A resistance plate as called for in claim 8 wherein a portion of said high resistance coating over said plate is removed from said plate between said spokes in close inner adjacency to center of said disk.

10. A resistance plate as called for in claim 8 wherein the inner ends of said radially extending spokes of highly conductive material are electrically connected together adjacent the axis of said plate.

11. A resistance plate as called for in claim 8 wherein said spokes are of differing widths.

12. A resistance plate as called for in claim 8 wherein said spokes are disposed in differing spaced relation with respect to each other about the surface of said plate.

13. A resistance plate as called for in claim 8 wherein said spokes are wedge shaped in configuration and with the diminishing end of said wedge extending substantially to the center of said plate.

14. A resistance plate as called for in claim 8 wherein the plate is circular in form and rotatable about its central disposed transverse axis.

* * * * *